US005435305A

United States Patent [19]

Rankin, Sr.

[11] Patent Number: 5,435,305

[45] Date of Patent: Jul. 25, 1995

[54] EMERGENCY AIR SUPPLY PACK

[76] Inventor: Pleasant P. Rankin, Sr., R.R. 1, Box 375, Tunas, Mo. 65764

[21] Appl. No.: 66,910

[22] Filed: May 24, 1993

[51] Int. Cl.[6] ..... A62B 7/00

[52] U.S. Cl. ..... 128/205.22; 128/204.18

[58] Field of Search ..... 128/201.29, 202.13, 128/202.16, 202.18, 202.27, 204.18, 205.11, 205.21, 205.22

[56] References Cited

U.S. PATENT DOCUMENTS

| | | | |
|---|---|---|---|
| 771,801 | 10/1904 | Andrew | 128/201.23 |
| 986,907 | 3/1911 | Chapin | 128/205.22 |
| 1,133,932 | 3/1915 | Christiansen | 128/205.22 |
| 1,185,392 | 5/1916 | Ganzer | 128/202.19 |
| 1,288,857 | 12/1918 | Farr | 128/205.22 |
| 2,348,074 | 5/1944 | Lambertsen | 128/205.25 |
| 2,380,372 | 7/1945 | Alderfer | 128/205.22 |
| 2,844,145 | 7/1958 | Berge | 128/205.22 |
| 3,338,238 | 8/1967 | Warncke | 128/205.12 |
| 3,491,752 | 1/1970 | Cowley | 128/205.22 |
| 4,253,454 | 3/1981 | Warncke | 128/205.22 |
| 4,561,476 | 12/1985 | Bunkoczy . | |
| 4,932,403 | 6/1990 | Scholley | 128/205.22 |
| 5,036,845 | 8/1991 | Scholley | 128/205.22 |

FOREIGN PATENT DOCUMENTS

| | | | |
|---|---|---|---|
| 13709 | 6/1956 | Germany | 128/205.22 |

*Primary Examiner*—Edgar S. Burr

*Assistant Examiner*—Aaron J. Lewis

*Attorney, Agent, or Firm*—Kokjer, Kircher, Bowman & Johnson

[57] ABSTRACT

An emergency air supply including a body conforming air supply tank having a reduce dimension in the direction extending outwardly from the user. The air supply tank is preferably formed of a high strength alloy tubular material formed into a closed loop having a closed geometric configuration. This closed geometric configuration may include one or more cross members extending across the central portion of the geometric figure and formed of the same tubular alloy and operatively connected to the closed figure to therefore define a further portion of the tank. The closed figure preferably has a complex shape which conforms to a predetermined portion of the users body, such as the back, chest, hip, thigh or upper arm. Various straps may be associated with the air tank to hold a tank in position upon the users body. An air hose connection nipple is provided upon the tube forming the storage tank such that a standard air hose and fresh air mask may be connected to the nipple to allow the compressed air within the tank to pass through the hose and into the mask for use by the user. Preferably, the nipple extends into the central portion defined by the closed geometric shape to reduce the overall size of the device and to reduce the thickness of the device in a direction extending outwardly from the user's body.

8 Claims, 2 Drawing Sheets

EMERGENCY AIR SUPPLY PACK

BACKGROUND OF THE INVENTION

1. Field of the Invention

The present invention relates in general to self contained breathing apparatus. In particular, the present invention relates to an improved tank for the storage of compressed air for emergency use.

2. Description of the Related Art

It has been known for some time that workers and others in areas in which the air supply may be depleted or contaminated should be provided with a supply of compressed air and means for allowing the user to access the supply of compressed air such that the worker may use such emergency supply of air to leave the depleted or contaminated area. For example, U.S. Pat. No. 3,491,752 to Crowley shows an elongated tube having a first closed end and a second open end to which is connected an air hose and air mask. The elongated tube serves as the storage tank, and is coiled to provide an adequate supply of air while maintaining a sufficiently small overall size. While this arrangement could be operable, the cost involved in providing the contoured coil of the storage tank is commercially unacceptable. Once commercial device for this purpose is sold under the trademark SCA-PAK TM by Scott Aviation, Corp. of Lancaster, N.Y. This device has enjoyed commercial success due to its relatively low cost and ease of use. However, the SCA-PAK TM is formed as a general cylinder having the air hose connection to a first longitudinal end. The cylindrical construction has a relatively large diameter (over four and one-half inches) which makes the device prone to catching upon protuberances, causing the wearer to become stuck or entangled in close quarters.

SUMMARY OF THE INVENTION

An object of the present invention is to provide an emergency air supply which will provide a sufficient quantity of air to allow a worker to exit an oxygen depleted or contaminated area.

Another object of the present invention is to provide an air tank for such an emergency air supply which will hold a sufficient quantity of air to provide a continuous air supply for a sufficient amount of time for normal exits from such depleted or contaminated areas.

It is a further object to provide a tank for an emergency air supply which has a relatively small thickness and is contoured for use on a particular portion of the users body, such that the tank does not provide an impediment to the user entering confined spaces.

It is yet another object of the present invention to provide an air tank for an emergency air supply which is in the form of a closed geometric figure, with the attachments for an associated air hose do not increase the thickness of the tank outward from the user and will thus allow the user to enter confined spaces.

These and other objects are achieved by an emergency air supply including a body conforming air supply tank having a reduce dimension in the direction extending outwardly from the user. The air supply tank is preferably formed of a high strength alloy tubular material formed into a closed loop having a closed geometric configuration. This closed geometric configuration may include one or more cross members extending across the central portion of the geometric figure and formed of the same tubular alloy and operatively connected to the closed figure to therefore define a further portion of the tank. The closed figure preferably has a complex shape which conforms to a predetermined portion of the users body, such as the back, chest, hip, thigh or upper arm. Various straps may be associated with the air tank to hold a tank in position upon the users body. An air hose connection nipple is provided upon the tube forming the storage tank such that a standard air hose and fresh air mask may be connected to the nipple to allow the compressed air within the tank to pass through the hose and into the mask for use by the user. Preferably, the nipple extends into the central portion defined by the closed geometric shape to reduce the overall size of the device and to reduce the thickness of the device in a direction extending outwardly from the user's body.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
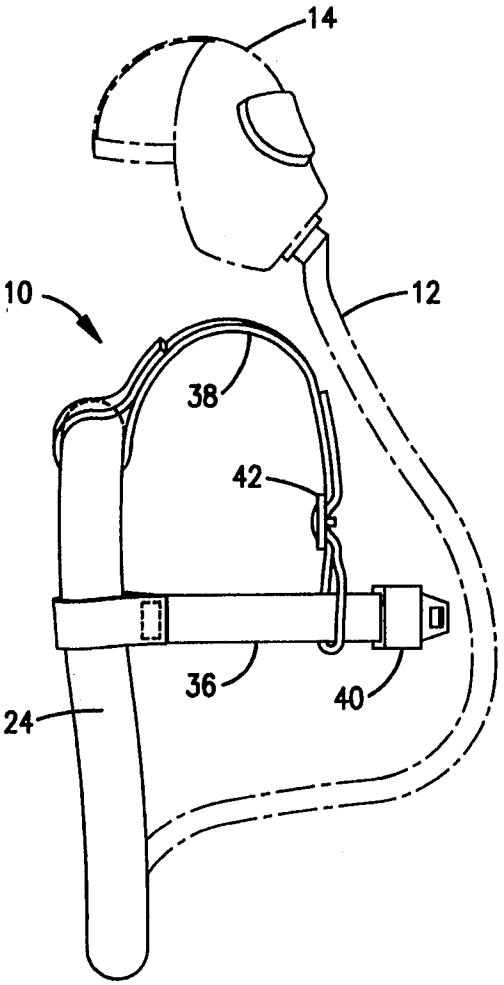
FIG. 1 is a side view of a tank according to the present invention indicating its relative position upon a user's body with respect to an air hose and fresh air mask to be employed with the tank.

With reference to FIG. 1, a first embodiment of an air supply pack according to the present invention is generally designated by reference numeral 10. As will become apparent from the discussion below, the pack 10 defines a generally closed volume which is adapted to contain and store a supply of compressed air for emergency use. In general terms, the pack 10 will be operatively connected to an air supply hose 12 at a first end thereof, with a second end of the air supply hose being connected to a fresh air mask 14 adapted to mount upon the user's face or head such that the user may inhale the air from the tank 10 passing through the hose 12.

Figure 3:
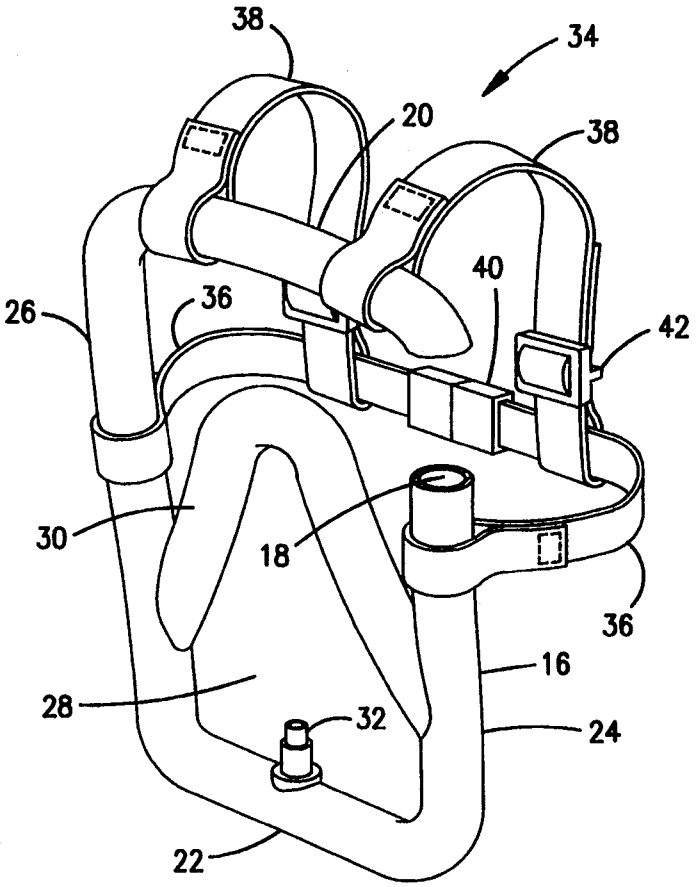
FIG. 3 is a perspective view and partial break-away of the device of FIG. 1.
Figure 2:
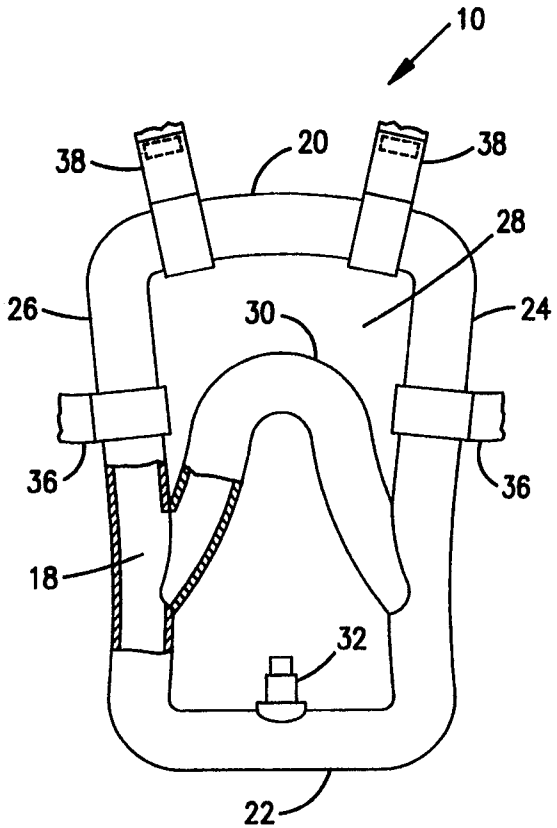
FIG. 2 is a front view in partial cross-section of the device of FIG. 1.

As is best shown in FIGS. 2 and 3, the pack 10 includes a tank formed of at least one closed segment of tubular material 16 which thus defines a closed volume 18 therein. The tubular material may be formed of various materials. However, as the tubular material will essentially form a pressure vessel for the containment of compressed air, the strength of the tubular material, for a particular geometric configuration, will determine the pressure which may be contained therein, and thus the maximum volume of air which may be retained within volume 18. The amount of air retained within volume 18 necessarily determines the amount of time air may be supplied to the user (assuming constant volumetric flow rate) and therefore as large a volume and as high a pressure as is possible is desired. Additionally, it is desirable that the tubular material 16 have as small an outer diameter as is possible, to reduce the extent to which the tank extends beyond the users body.

To meet these various and conflicting criteria, one suitable material for the tubular material 16 is a UNS alloy number N08825, defined in specification number B423 (ASME B31.1-1989 Edition). When'formed as a seamless pipe, this alloy will provide exceptional strength and will allow manufacture of storage tanks according to the present invention having the ability to supply emergency air for periods between two and 45 minutes, approximately.

As noted above, the tank is formed as a preferably seamless tube which is formed into a closed geometric configuration. For example, as is best shown in FIG. 2, the first embodiment 10 includes an upper crossbar 20, lower crossbar 22, and right and left struts 24 and 26, respectively. Each of the crossbars and struts 20–26 is formed of the tubular material 16 and are connected end to end to define the single continuous closed volume 18 (the term "connected" as used herein will encompass tube segments fixed together as by welding, as well as tube segments defined solely by interposed bends in the locally monolithic tubular material). The closed geometric shape of the crossbars and struts 20–26 form a central opening 28 surrounded by the crossbars and struts.

The embodiment of FIGS. 1–3 is preferably employed as a back or chest pack, with the struts and crossbars having an appropriate size and shape. For example, the upper crossbar 20 may have a length corresponding to an average human shoulder length when used as a back pack, or may have a length corresponding to an average distance between human collar bones, such as to allow the user to pivot the arms forward without restriction. The struts 24 and 26 will likewise have an appropriate length. For example, when used as a backpack the struts may have a length corresponding generally to an average distance between the central portion of the shoulder blades to the small of the back or upper edge of the pelvis. As is best shown in FIG. 1, the struts may also have a slight S-shape in side view to more readily conform with the curvature of the human spine. Additionally, the lower crossbar 22 may have a length which is less than that of upper crossbar 20, and which roughly corresponds to an average pelvis width. In a similar manner, where the embodiment of FIGS. 1–3 is employed as a chest pack the struts 24 and 26 will typically have a shorter extent, possible ending approximately at the bottom of the rib cage, to allow the user to freely bend forward. For such an embodiment the struts could also have a slight curvature, typically slightly convex inward towards the body to conform to the users chest. Although not shown, the upper and lower crossbars 20 and 22 may also include curvatures which would be seen from a top and bottom view, respectively, and which would typically be a slight concave inward towards the human body.

As shown in FIGS. 2 and 3, the first embodiment 10 may additionally include auxiliary tube segments 30. By "auxiliary", it is meant that the tube segments 30 provide additional volume for the closed volume 18, as the auxiliary tube segments 30 are operatively connected with the volume 18 (see FIG. 2), and not that these are a secondary air volume which may be activated upon depletion of the volume 18. The auxiliary tube segments 30 simply increase the volume of closed volume 18, thus providing additional air and therefore time for the user, in those embodiments which include a large central opening 28.

As is best shown in FIG. 2, the auxiliary tube segment 30 of this embodiment consists of a single tube segment extending between the right and left struts 24 and 26, and includes an upward bend such that the length of the tube segment is greater than that of either crossbars 20 or 22, thus increasing the volume 18 defined solely within the tube segment 30. Other arrangements are of course possible. For example, a second tube segment 30 similar to that shown in FIGS. 2 and 3 could be provided within the opening 28. Alternatively, the tube segment 30 could be an essentially straight bar (preferably however with slight curvature to conform to the human body) extending between the struts, thus providing room within the central opening for three or more of the tube segments 30. It is of course not necessary for the tube segments 30 to extend between the struts 24 and 26, and as such a tube segment 30 could extend between end points on a single strut, between the upper and lower crossbars, upon a single crossbar, or between an adjacent crossbar and strut at a diagonal. All that is strictly required is that the auxiliary tube segments maintain a sufficiently strong structure for the tank that it may reliably maintain the desired pressure, that the tank is sufficiently easy and cost effective to fabricate, and that there is preferably provided a sufficient free space to mount a nipple 32.

As is best shown in FIGS. 2 and 3, the pack 10 will include the nipple 32 operatively connected to one of the crossbars, struts or tube segments. The nipple 32 may be of any standard configuration which will allow ready attachment and detachment of the hose 12. It is preferred that the nipple 32 extend into the central opening 28 and be generally received within the plane defined by the crossbars and struts. This will ensure that the nipple 32 takes up the least amount of space, does not contribute to the thickness of the tank, and provides protection for the nipple 32 against impact during use.

The pack 10 also includes a strap arrangement generally designated by reference numeral 34 (FIG. 3) to releasable secure the tubular material 16 to the user.

The strap arrangement 34 may of course take many configurations, depending upon the particular use and the need to maintain the tubes in position upon the user. The preferred arrangement for embodiment 10, which is to be employed as a back or chest pack, is to provide a pair of lateral straps 36, one extending from each of the struts 24 and 26, and a pair of shoulder straps 38 extending from the upper crossbar 20. Each of the straps 36 and 38 is secured to the associated strut or crossbar, preferably by forming a loop about the associated strut or crossbar and securing the strap to itself (as by sewing, ultrasonic welding, etc.). This will eliminate the need for securing a strap receiving loop or other element to the tubular material 16, which could possibly reduce the strength of the tube at that position. For improved adjustment, it is preferred that the loops of the strap material are secured about the struts and crossbar with a sliding fit, such that they may move along the struts or crossbar, although it is possible to fixedly secure such loops to the strut or crossbar, as by adhesive.

As is shown in FIGS. 1 and 3, the free ends of the chest straps 36 include a fastener 40 such that the free ends may be secured together. In this embodiment the fastener takes the form of a snap buckle, but other fasteners such as snaps, hook and loop fasteners, buckles, etc. could be employed. One or both sides of the fastener 40 may include an appropriate length adjustment for the associated strap 36.

The free ends of the shoulder straps 38 may also be releasable connected to the fastener 40, but to reduce the complexity of such a fastener it is preferred that the free ends of the shoulder straps 38 simply form loops about the chest straps 36 with a sliding fit, and are adjustably secured to themselves by adjustable retainers 42, as are known in the art.

The straps 36 and 38 may be formed of a wide variety of materials, although it is preferred that the straps be formed of standard nylon webbing. Similarly, various other strap arrangements could of course be employed, such as providing a lower strap extending downward from the lower crossbar, between the users legs, and connecting to the lateral strap or fastener, or the straps could be formed of elastic elements, in which case it would be possible to employ a single lateral strap having both ends connected to the tank.

Additionally, the term "strap arrangement" is intended to be interpreted broadly, and may includes a vest or jacket which supports the tubular material thereon.

Figure 4:
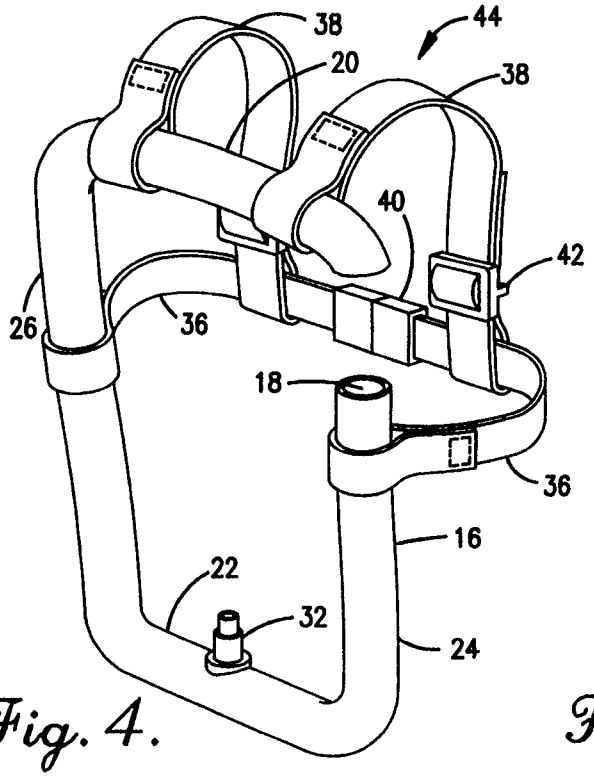
FIG. 4 is a perspective view and partial break-away of a second embodiment according to the present invention.

With reference to FIG. 4, a second embodiment according to the present invention is generally designated by reference numeral 44. This second embodiment is substantially identical to the first embodiment 10, with the exception that the tubular material 16 does not include an auxiliary tube segment 30.

Figure 6:
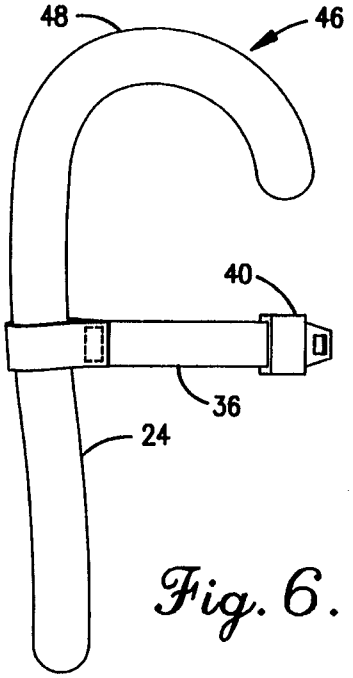
FIG. 6 is a side view of the embodiment of FIG. 5.
Figure 5:
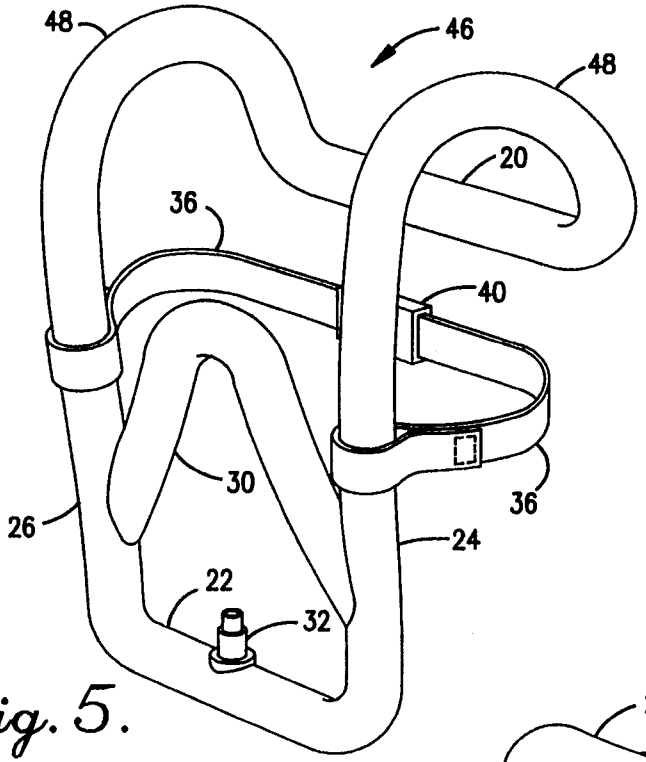
FIG. 5 is a perspective view of a third embodiment according to the present invention.

A third embodiment according to the present invention is shown in FIGS. 5 and 6, and is generally designated by reference numeral 46. The lower portion of this embodiment is substantially identical to that shown in FIGS. 1–3, and includes the lower cross bar 22, the right and left struts 24 and 26, the auxiliary tube segment 30 and the nipple 32. The extreme upper portion of this embodiment is also similar to that shown in FIGS. 1–3 and includes the upper crossbar 20. However, the upper portions of the right and left struts 24 and 26 are formed with curved shoulder segments 48 which are adapted to rest upon the shoulders of the user, with the lower crossbar 22 resting across the lower abdomen of the user while the upper crossbar 20 rests upon the upper back of the user, or vise versa, depending upon whether the tank is employed as a chest pack or a shoulder pack. As is best shown in FIG. 6, this will result in the plane defined by the crossbars and struts having a first section which is generally planar and a second section which is in the form of a plane curved about a line extending through the shoulder sockets of the user, and having a radius substantially equal to that of the human shoulder.

With this arrangement the shoulder segments 48 will rest upon the shoulders of the user to prevent downward movement of the tank. As such, the shoulder straps 38 are not necessary, and the pack 46 may be secured in place simply by use of the lateral straps 36 and fastener 40.

Figure 8:
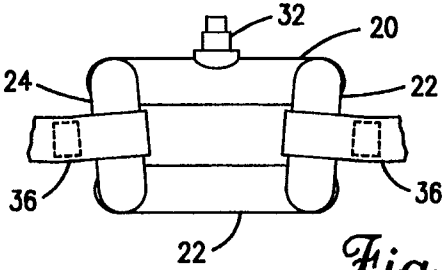
FIG. 8 is a rear view of the embodiment of FIG. 7.
Figure 7:
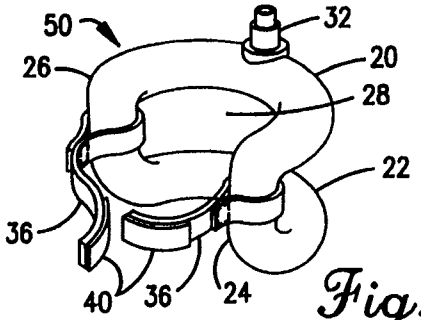
FIG. 7 is a perspective view of a forth embodiment according to the present invention.

A fourth embodiment according to the present invention is shown in FIG. 7 and 8, and is generally designated by reference numeral 50. This embodiment, as with the other embodiments, includes upper and lower crossbars 20 and 22, and right and left struts 24 and 26 to define a substantially rectangular closed geometric form with a central opening 28. In this embodiment, however, the tank is adapted to be secured to the forearm (or thigh) of the user. As such, the upper and lower crossbars 20 and 24 have a pronounced curvature substantially corresponding to the average bicep (or thigh), and the crossbars and struts will define a plane curved about a line extending between the shoulder and elbow of the user.

The struts 24 and 26 for this embodiment may be relatively short, such that the user will have a sufficient freedom of movement to bend the elbow without restriction due to contacting the tubular material 16. This reduce length of the struts will necessarily reduce the size of the opening 28, such that it may be preferred in this particular embodiment to have the nipple 32 extending outwardly away from the opening 28, although it is preferred that it still not extend outward in the thickness direction.

This arrangement also includes a strap arrangement which includes a pair of lateral bands 36, in this particular instance with the fastener 40 consisting of a mating hook and loop fastener, such as VELCRO®. As is best shown in FIG. 8, to more fully conform to the upper arm or thigh of the user, the lower crossbar 22 may have a slightly different radius than that of the upper crossbar, with a slightly smaller radius being shown in FIG. 8. This will result in the plane defined by the crossbars and struts as being a section of a cone.

Figure 9:
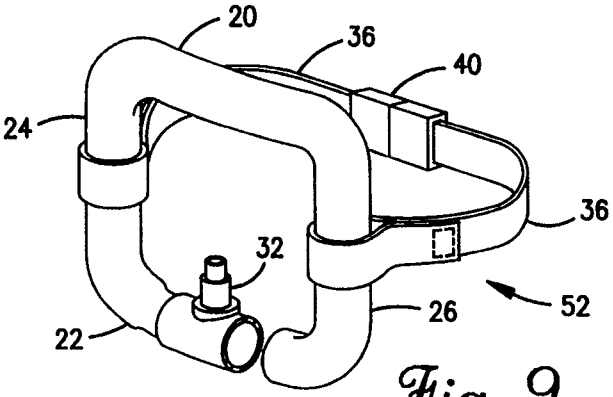
FIG. 9 is a perspective view of a fifth embodiment according to the present invention.

With reference to FIG. 9 there is shown a fifth embodiment of the present invention generally designated by reference numeral 52. In this embodiment the tank is adapted to be secured to the thigh (or hip) of the user. As such, and in a manner similar to the embodiment shown in FIGS. 7 and 8, the upper and lower crossbars 20 and 22 will have a radius substantially corresponding to an average human thigh (or hip). Similarly, the plane defined by the crossbars and struts will be curved about a line substantially extending between the human hip and knee. In this arrangement also, there is provided only the lateral bands 36 and fastener 40, which may extend about the thigh of the user.

As may be seen from the discussion above and the figures, the emergency air supply packs according to the present invention will provide the user with a substantial volume with emergency air while at the same time providing a reduced thickness in a direction exterior or outward of the human body, to provide a minimum of impediment to movement of the user through cramped spaces. While the various embodiments have been discussed individually, it should be apparent to those skilled in the art that various combinations of the various embodiments may be worn simultaneously, although preferably only a single tank is operatively connected to the mask 14 at a time. As such, the user could employ a pack according to FIGS. 2 and 3 as a back pack, a tank according to FIG. 5 as a chest pack, a pair of the tanks of FIGS. 7 and 8, with one on each arm, and a pair of the tanks of FIG. 9, with one on each thigh. Other arrangements to conform to other sections of the body, such as the calf or forearm could also be formed according to the present invention.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. An emergency air supply pack, comprising:

a tank for holding an emergency supply of air, said tank including a tubular member defining a closed volume to receive the air and formed into a closed geometric configuration including a top crossbar, a bottom crossbar, a right strut and a left strut, connected together end-to-end with each said strut having its ends respectively connected to ends of each of said crossbars, said crossbars and struts thereby defining and surrounding a central opening, at least one of said crossbars and said struts having at least one curvature to conform to a portion of the human body;

a nipple fixed to said tubular member and allowing access to said closed volume for entry and exit of the air, said nipple extending to a free end located within said central opening, and generally within a plane defined by said tank; and a strap arrangement including at least one strap connected to said tubular member to retain said tank in position upon the portion of the human body.

2. A pack as in claim 1, wherein said tubular member further includes at least one auxiliary tube segment extending in operative communication across said central opening with ends of said auxiliary tube segment being connected to said right and left struts.

3. A pack as in claim 1, wherein said at least one strap comprises two lateral straps, each extending from one of said struts, and said strap arrangement further includes fastener means for securing said two lateral straps together.

4. A pack as in claim 3, wherein said strap arrangement further includes a pair of shoulder straps extending from said upper crossbar, whereby said pack is adapted to rest upon the upper torso of the human body.

5. A pack as in claim 1, wherein each of said struts includes a similarly curved shoulder segment adapted to rest upon the shoulders of the human body.

6. A pack as in claim 5, wherein said tubular member further includes at least one auxiliary tube segment extending in operative communication across said central opening with ends of said auxiliary tube segment being connected to said right and left struts.

7. A pack as in claim 1, wherein said struts are substantially linear, and said crossbars each include a curvature in substantially the same direction, whereby said pack will conform to a human thigh or hip.

8. A pack as in claim 7, wherein said curvatures of said crossbars have substantially equal radii.

* * * * *